US005628166A

United States Patent [19]

Hannon

[11] Patent Number: 5,628,166

[45] Date of Patent: May 13, 1997

[54] HIGH SPEED NEWSPAPER BAGGER

[75] Inventor: Charles N. Hannon, Olathe, Kans.

[73] Assignee: Stepper, Inc., Olathe, Kans.

[21] Appl. No.: 492,928

[22] Filed: Jun. 21, 1995

[51] Int. Cl.[6] ..... B65B 43/42; B65B 43/14; B65B 43/44

[52] U.S. Cl. ..... 53/459; 53/473; 53/572

[58] Field of Search ..... 53/459, 469, 479, 53/572, 284.7, 375.9, 473

[56] References Cited

U.S. PATENT DOCUMENTS

| | | | |
|---|---|---|---|
| 3,491,514 | 1/1970 | Burford | 53/572 |
| 3,590,553 | 7/1971 | Formo | 53/572 X |
| 4,047,362 | 9/1977 | Lister et al. | 53/572 |
| 4,457,124 | 7/1984 | Hartmann | 53/572 X |
| 4,805,381 | 2/1989 | Hannon | 53/572 X |
| 4,923,064 | 5/1990 | Hannon | 53/572 X |
| 5,228,275 | 7/1993 | Formo | 53/572 |

*Primary Examiner*—Horace M. Culver

*Attorney, Agent, or Firm*—Hovey, Williams, Timmons & Collins

[57] ABSTRACT

Folded and tied newspapers are delivered in a stream to an infeed conveyor which moves the newspapers in succession toward an inserting station where a stack of flimsy plastic bags are waiting. Just prior to reaching the inserting station, the newspaper is gripped by high-speed accelerating rollers which fire the newspaper into the open mouth of the inflated top bag in the stack. High-speed ejector rollers then clamp onto the bagged newspaper and pull it off the holding wicket for movement on down the line. A special, transverse, bag supply shuttle has two separate bag holding zones along its length so that one zone containing an adequate supply of bags may be presented to the inserting station while the other, empty zone is restocked with a new supply. During shifting of the shuttle, the incoming stream of newspapers is diverted temporarily so that no newspapers are presented to the inserting station during manipulation of the shuttle.

16 Claims, 13 Drawing Sheets

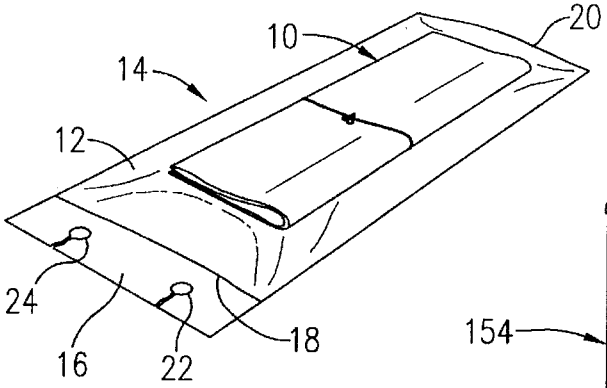
FIG. 26.
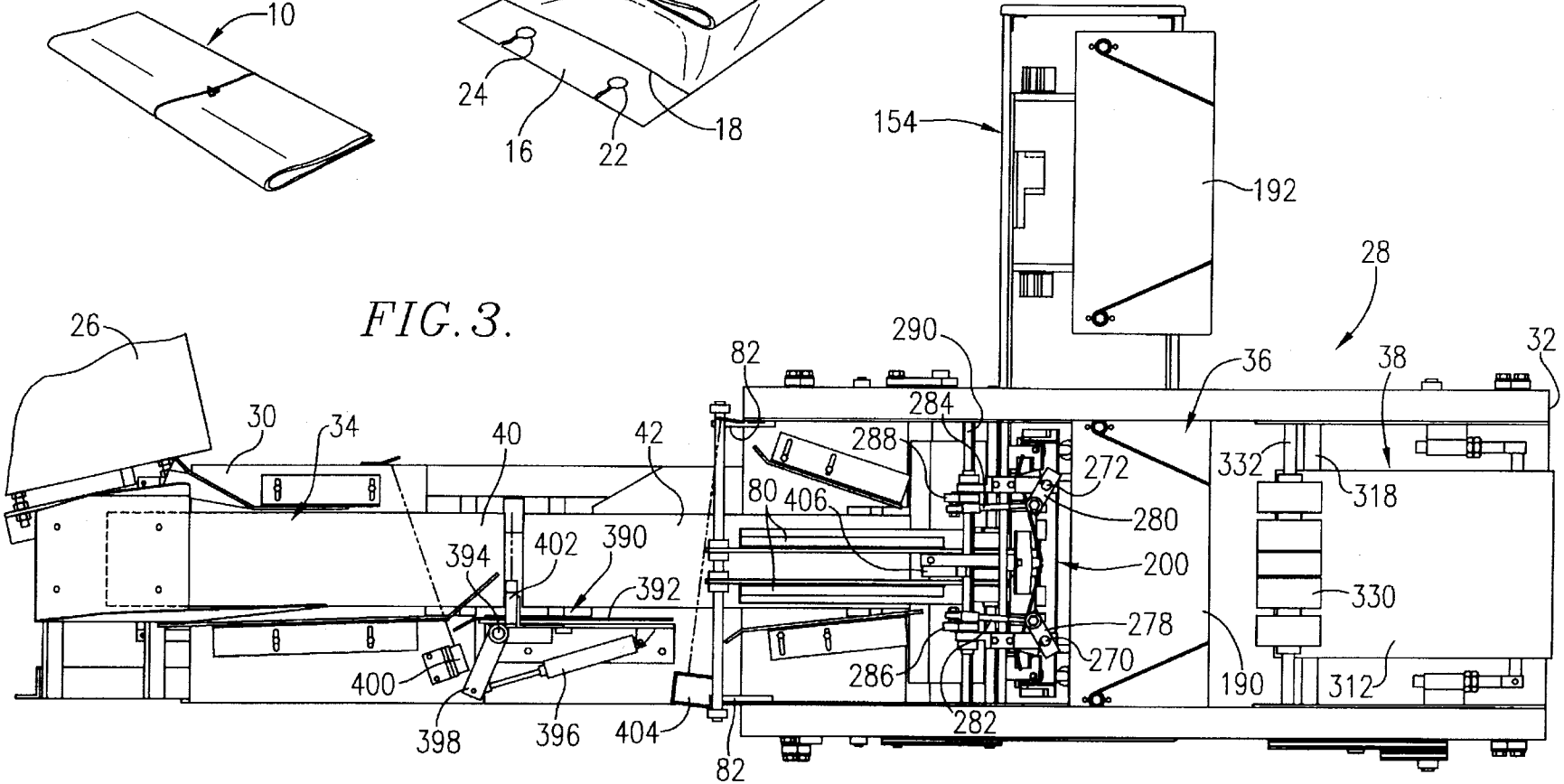
FIG. 3.
FIG. 25.

202
204
210
166
154
222
252
170
254
414
250
220
208
162
294
106
296
298
120
302
292
90
86
114
290
280
284
276
78
272
76
72
74
268
266
282
278
274
270
300
304
306
328
352
354
116
118
108
412
410
168
142
136
130
144
138
100
104
248
246

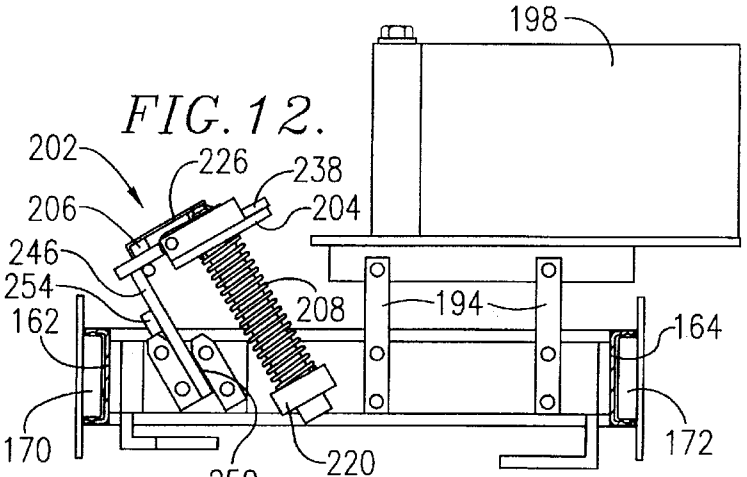
FIG. 12.
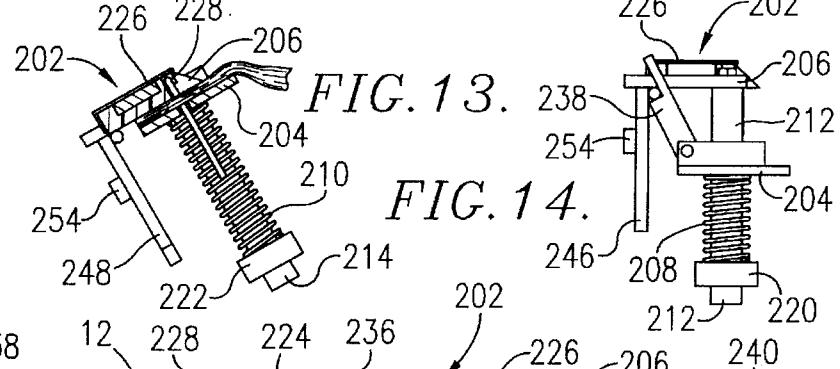
FIG. 13.
FIG. 14.
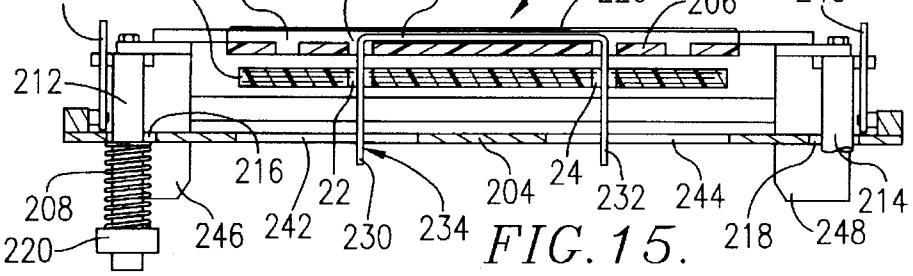
FIG. 15.
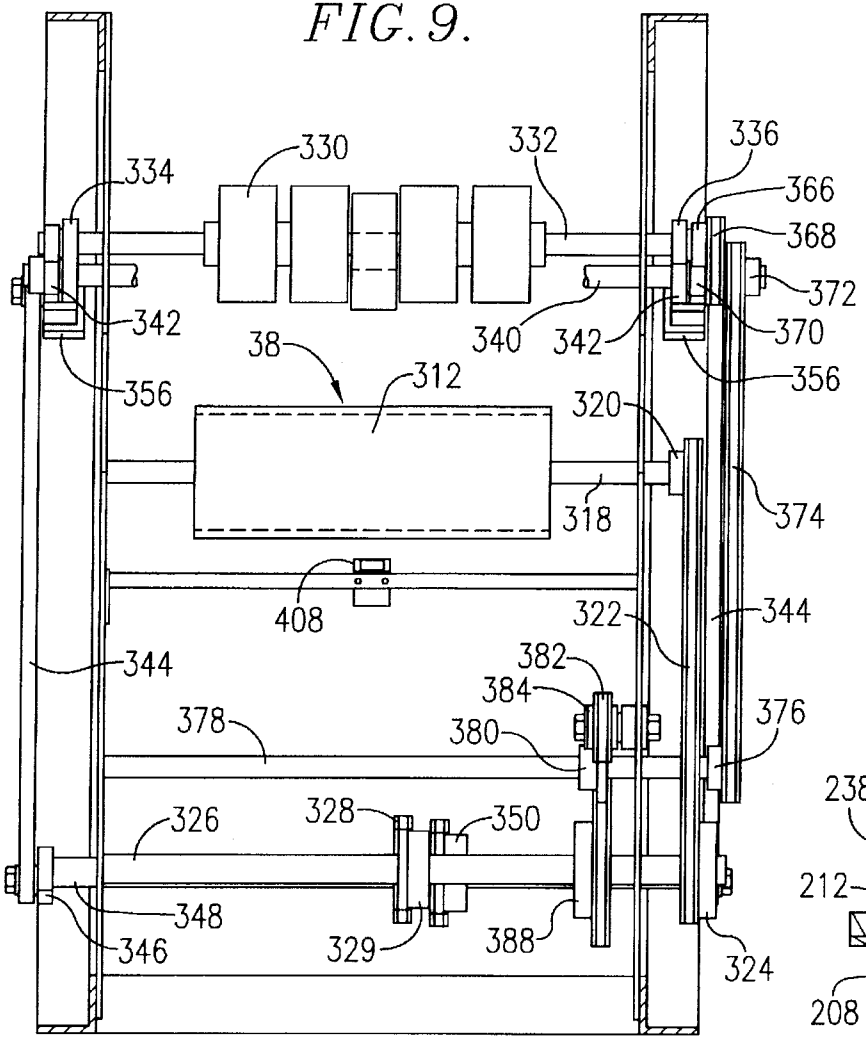
FIG. 9.

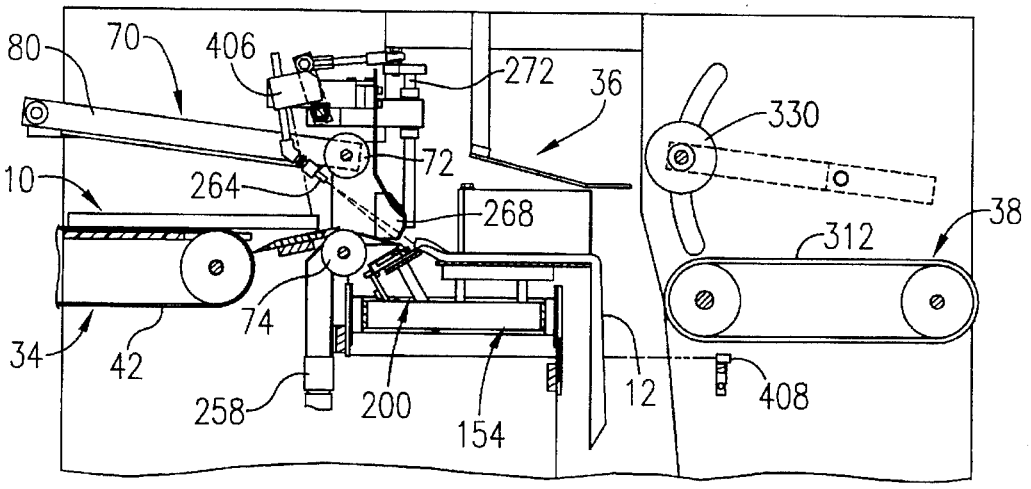
FIG. 17.
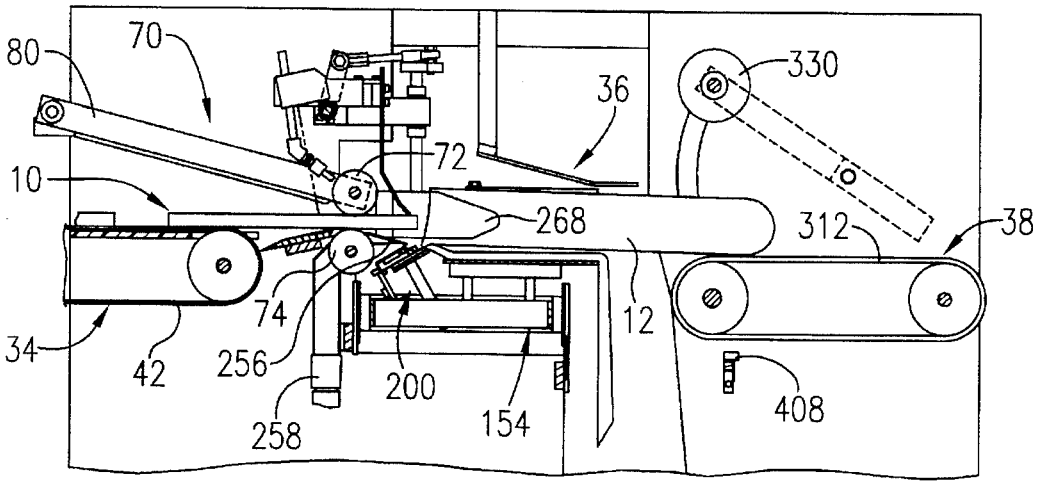
FIG. 18.
FIG. 19.
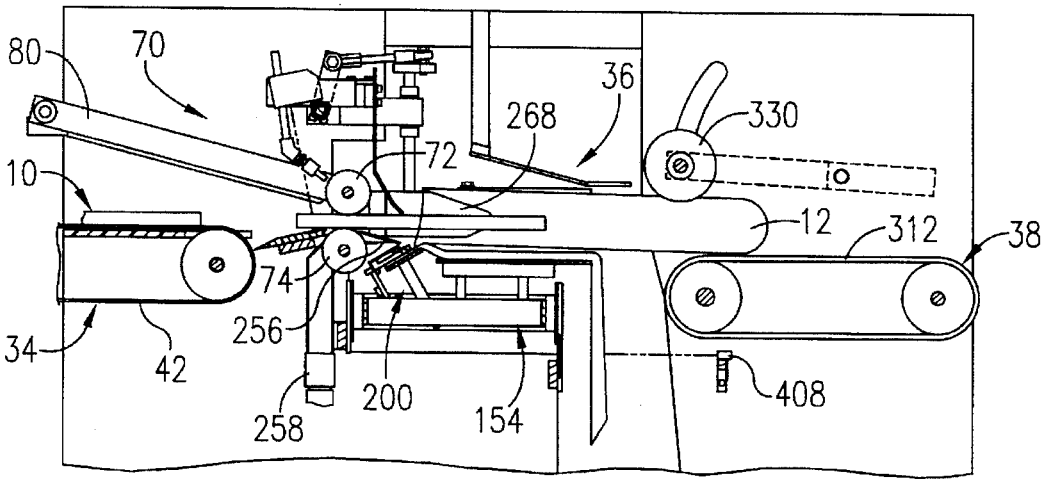

HIGH SPEED NEWSPAPER BAGGER

TECHNICAL FIELD

This invention relates to the field of newspaper handling equipment and, more particularly, to a machine for mechanically inserting newspapers and other difficult-to-handle articles into flimsy bags, such as those made from thin polyethylene material or the like, at a high rate of speed.

BACKGROUND

In my prior U.S. Pat. Nos. 4,805,381 and 4,923,064 there is disclosed and claimed a high speed machine for inserting bulky newspapers and like articles into a plastic envelope or bag and then sealing such covering to provide a totally enclosed, protective wrapper for the newspaper. The invention as set forth in such patents is particularly useful in connection with large, bulky Sunday editions which contain many loose advertising inserts, coupons and other relatively slick items that have a tendency to slip out of the newspaper during handling. The sealed package also provides a safeguard against pilfering of valuable coupons from inside the newspapers.

While the bagger as disclosed in the '381 and '064 Patents performs quite well for its intended purpose, it does necessitate the use of a relatively large plastic bag of special configuration since the newspapers are bagged in a flat, unfolded condition. Moreover, my prior system is generally limited to the bagging of relatively thick newspapers due to the type of pusher system that is utilized to advance the newspapers into the open bags. Thin newspapers and other like articles do not have enough columnar strength in the direction of feeding to withstand the pushing force of the feeder. Furthermore, speeds are somewhat limited.

SUMMARY OF THE INVENTION

Accordingly, an important object of the present invention is to provide a newspaper bagging system which can use relatively standard plastic bags typically employed by residential carriers today to provide a protective wrapping for the newspapers against rain and other adverse conditions. Another important object is to provide a machine which can rapidly and reliably insert folded and tied newspapers into their protective bags to free up the personnel to concentrate on other, more important tasks. Still further, an important object of the invention is to provide a system which is highly compatible with existing folding/tieing equipment available from the assignee of the present invention so that the newspaper to be distributed can be collated, folded, tied and bagged all by the same system within a relatively short period of time and in a constant or continuous process with high through put speeds. In this connection, a further important object of the invention is to provide a way of momentarily diverting the stream of assembled newspapers while the supply of plastic bags at the inserting station is replenished so that there is no need to turn off the system and interrupt the collating, folding and tieing operations which are proceeding upstream from the bagging operations.

In carrying out the foregoing and other important objects of the invention, the present system contemplates receiving the folded and tied newspapers in a steady stream from the folder/tier. A flat conveyor moves the newspapers in succession toward an inserting station where a stack of thin plastic bags are waiting. The bags are staked onto a holder by a retaining wicket that passes through an extended flap at the mouth of the bags, and all of the bags face in the upstream direction. As the newspaper approaches, the top bag of the stack is inflated by a high-pressure airjet, whereupon the newspaper is grabbed by an accelerator and fixed into the open bag at a much higher velocity. A pair of ejector rollers then clamp down upon the bagged newspaper, tear it off the wicket and propel it downstream away from the inserting station to clear the area for the next newspaper.

When the bag supply at the inserting station runs low, such condition is sensed by an optical detector which in turn signals an upstream diverter to temporarily direct the newspapers on the main conveyor of the machine to an alternate location. During such diversion of the newspapers, and without interrupting the continuing operation of the collator/folder/tier, a shuttle at the inserting station may be shifted to bring a stand-by bag supply into operating position and remove the old stack to a position outside the path of travel of the newspapers so that the empty wicket can be removed and a full wicket attached in its place. The existence of a full bag supply at the inserting station is sensed by the optical detector, which then signals the diverter to return to its initial stand-by position and allow the regular flow of newspapers to resume.

These and other important objects of the present invention will become apparent from the drawings and detailed description which follows.

BRIEF DESCRIPTION OF THE DRAWINGS

FIG. 3 is a top plan view of the machine showing in fragmentary form the discharge end of a collator/folder/tier;

FIG. 9 is another transverse vertical cross-sectional view through the machine taken slightly downstream from the position illustrated in FIG. 8 and showing details of the ejector for the bagged newspapers;

FIG. 12 is an enlarged, transverse, vertical cross-sectional view through one end of the shuttle with a bag holder in place;

FIG. 13 is a fragmentary detail view of a bag holder illustrating the manner in which the bags are staked down in position;

FIG. 14 is a side elevational view of a bag holder in its open position to permit the acceptance of a new wicket and stack of bags on the holder;

FIG. 15 is a vertical longitudinal cross-sectional view through the opened bag holder showing the wickets and bags mounted thereon;

FIG. 17 is a fragmentary, schematic, vertical longitudinal cross-sectional view generally through the inserting station of the machine illustrating how the top bag in the stack is opened by a high pressure airjet as the next newspaper approaches the inserting station;

FIG. 18 is a similar vertical cross-sectional view through the inserting station taken at a slightly later point in the process where the bag is inflated and the newspaper is being fired into the opened bag by the accelerator rollers;

FIG. 19 is a similar view of the insertion station showing the newspaper part way into the bag and the ejector rollers starting to close against the bag;

FIG. 25 is a perspective view of a folded and tied newspaper of the type contemplated to be bagged by the method and apparatus of the present invention;

FIG. 26 is a perspective view of a bagged newspaper; and

DETAILED DESCRIPTION

Figure 1:
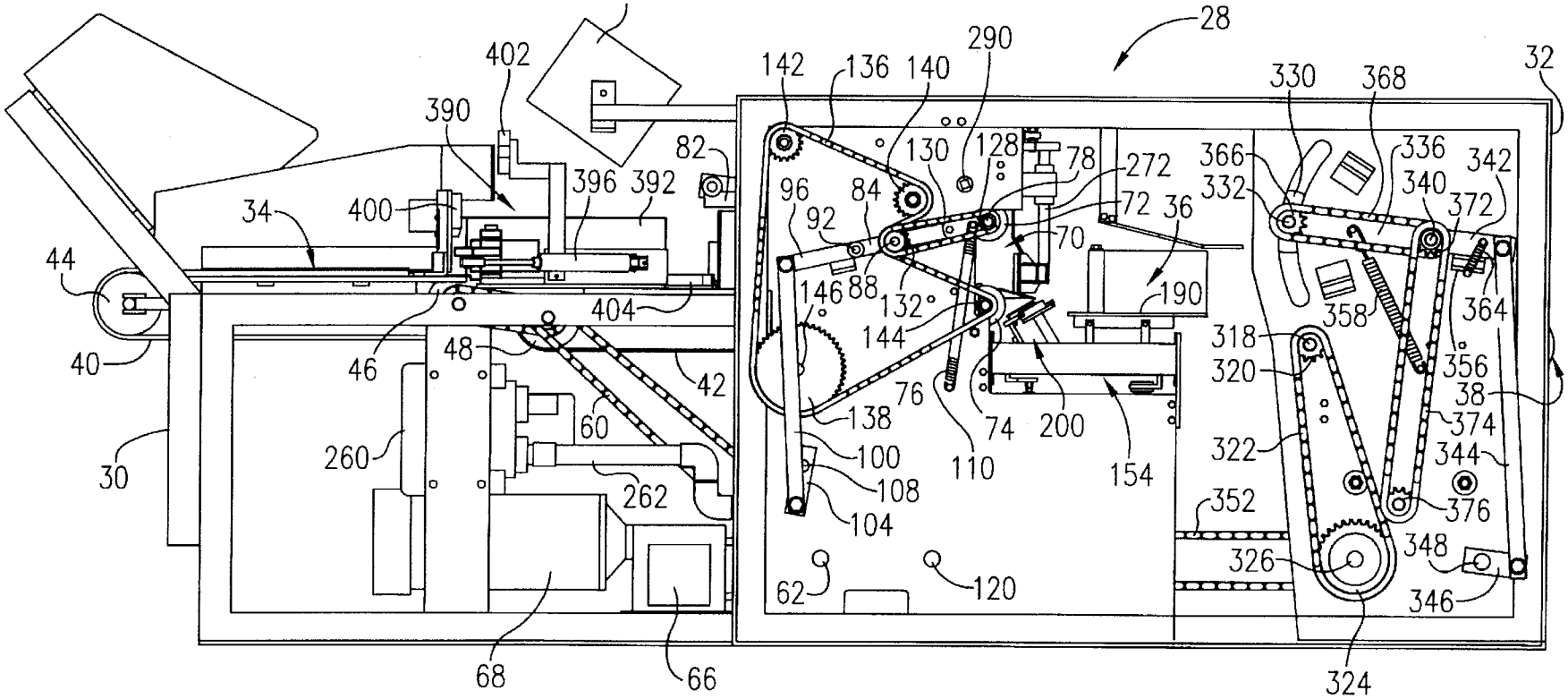
FIG. 1 is a side elevational view of a bagging machine constructed in accordance with the principles of the present invention.
Figure 2:
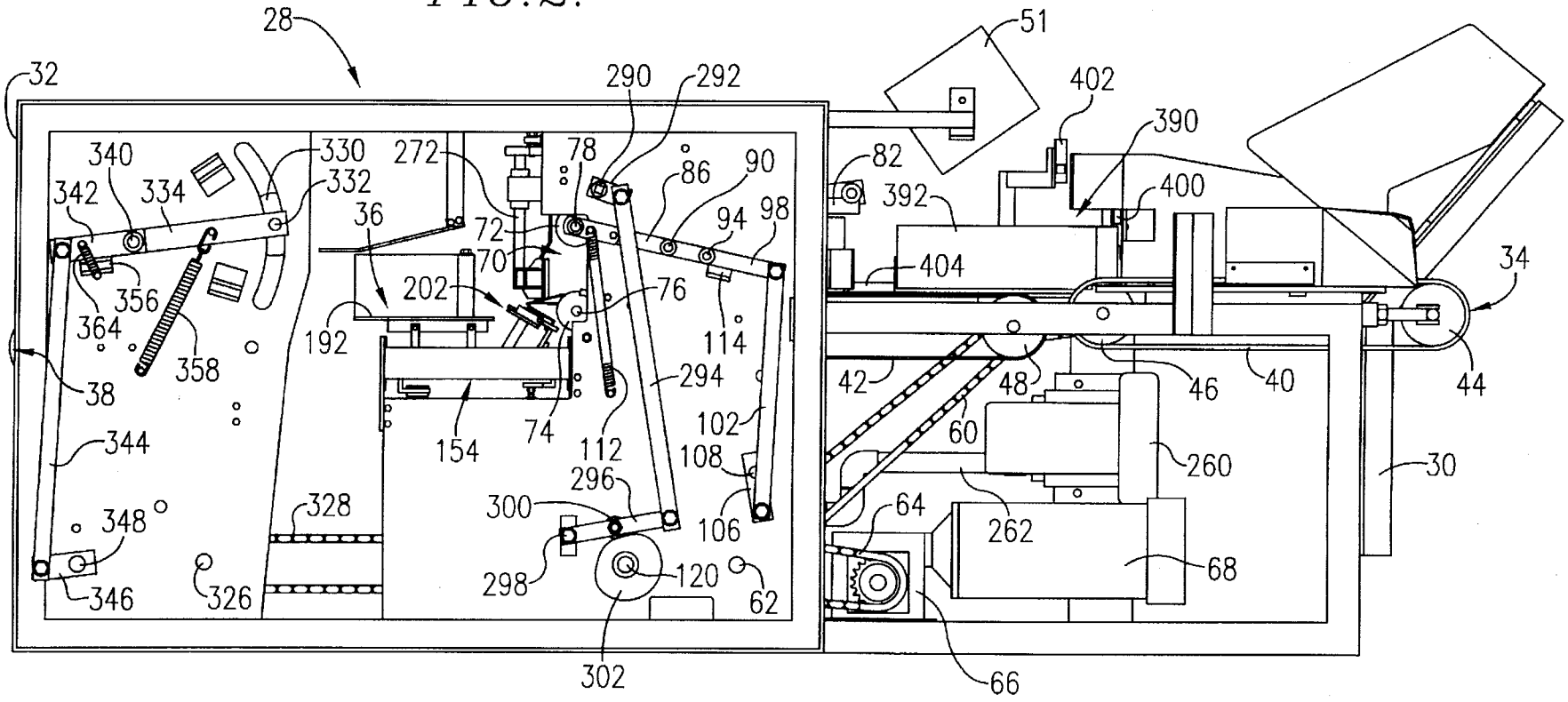
FIG. 2 is an opposite side elevational view of the machine.

With initial reference to FIG. 25, the present invention is particularly well adapted for placing a folded and tied newspaper such as the newspaper 10 into a flimsy plastic bag 12 as shown in FIG. 26 so as to present a bagged newspaper product 14. The bag 12 has a lip or flap 16 projecting outwardly beyond the mouth 18 which is perforated in two places to present mounting holes 22 and 24 to facilitate staking of the bags onto wickets as will hereinafter become apparent. The mouth 18 does not become sealed in accordance with the principles of the present invention. The opposite end 20 or bottom of the bag is closed.

Figure 4:
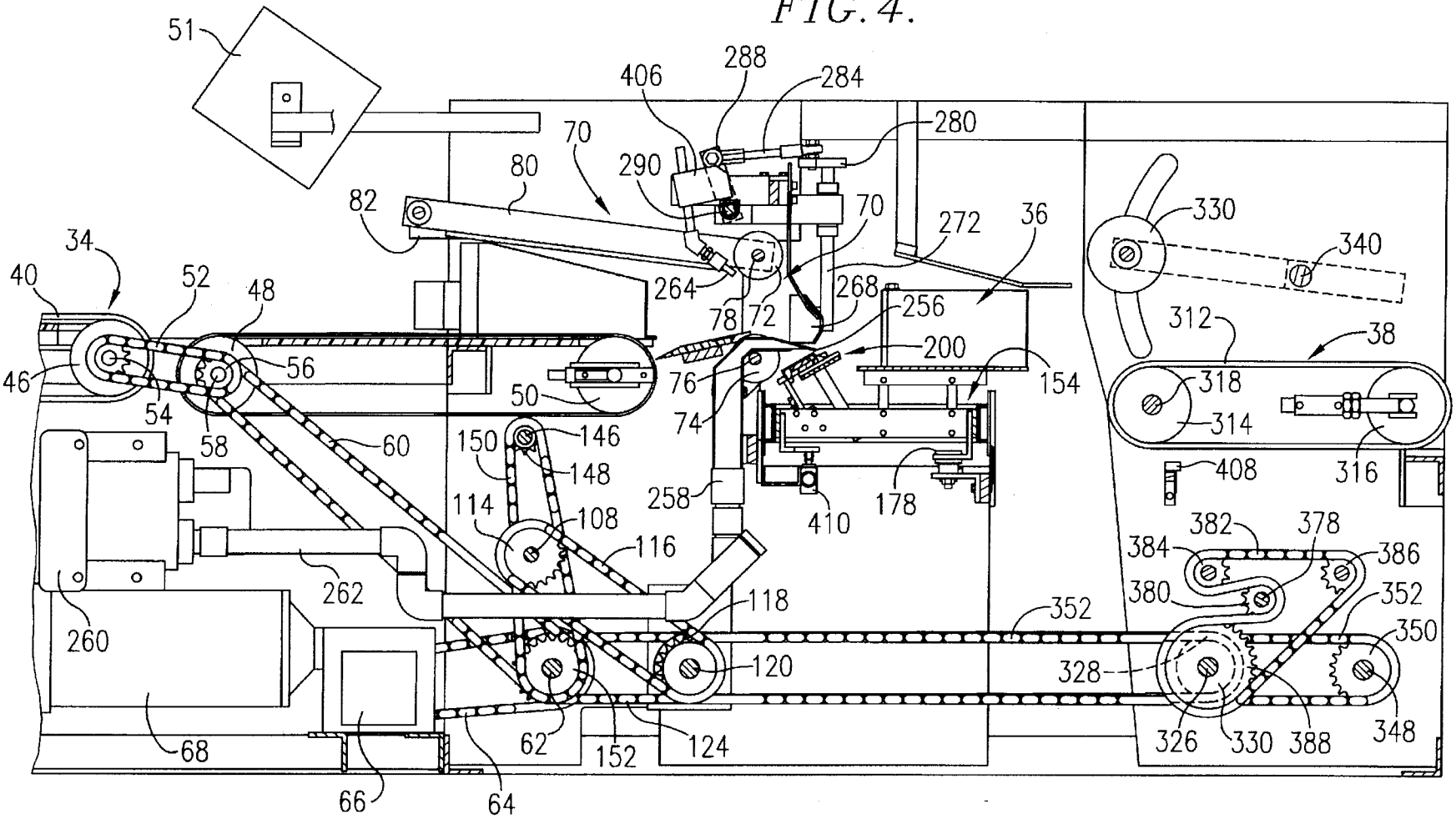
FIG. 4 is a slightly enlarged, fragmentary longitudinal cross-sectional view through the machine illustrating in particular the motor and drives for various parts of the machine.
Figures 5, 16:
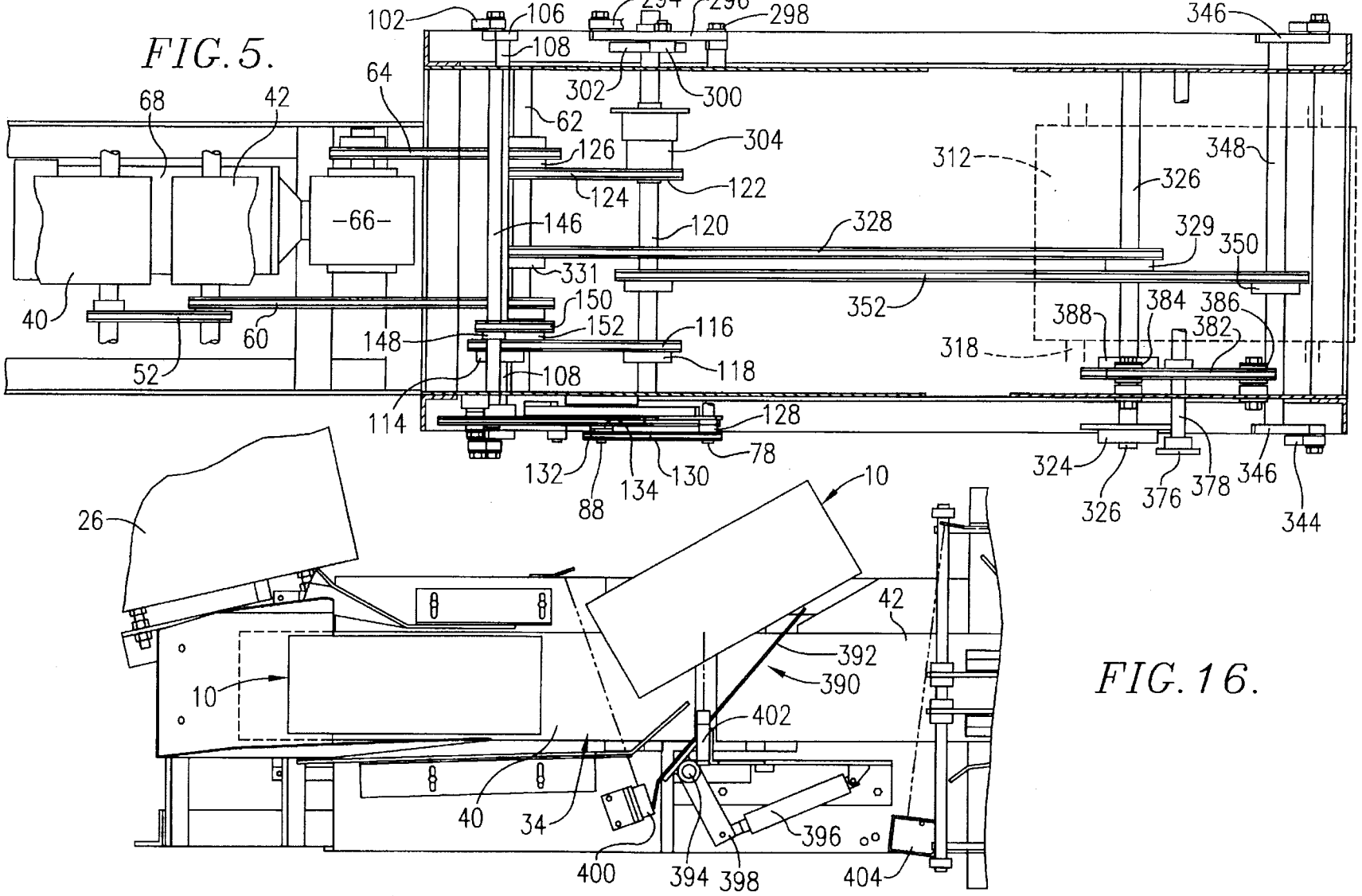
FIG. 5 is a fragmentary, horizontal sectional view of the machine illustrating the drives.
FIG. 16 is an enlarged, fragmentary top plan view of the inlet end of the bagging machine illustrating the manner in which newspapers are diverted from their normal path of travel during restocking of a fresh supply of bags in the machine.

The newspaper 10 may be collated, folded and tied by a Stepper Model 3000 Folder/Tier available from the assignee of the present invention. The discharge outlet 26 from such a machine is illustrated in FIGS. 3 and 16 for delivering the newspaper 10 to the machine of the present invention which is, denoted broadly by the numeral 28. As shown best in FIG. 3, machine 28 is adapted to receive folded newspapers 10 or other articles at an entry end 30 and to discharge the bagged newspapers 14 at an outlet end 32. A conveyor 34 at the entry end 30 moves from left to right viewing FIGS. 1, 3 and 4 for moving the newspapers 10 in succession toward an inserting station broadly denoted by the numeral 36 generally near the center of the machine. From the inserting station 36, the bagged newspapers 14 then leave the machine via a discharge conveyor 38.

The conveyor 34 is arranged in two sections, each of which uses a wide flat, endless belt such as the belts 40 and 42. As shown in FIGS. 1 and 4, the belt 40 is entrained around a pair of cylindrical rolls 44 and 46; similarly, the belt 42 is trained around a pair of cylindrical rolls 48 and 50. The belt 40 is slightly elevated with respect to the belt 42 to present a slight step down in the conveyor 34 which assists in carrying out the temporary diversion of the stream of newspapers when the supply of plastic bags is being replenished, as will hereinafter be explained in more detail An ionizer 51 (FIG. 1) is suspended above the conveyor 34 for directing ionized air down onto the newspapers and plastic bags as the bagging operation is carried out, whereby to promote smooth operation.

As shown in FIG. 4, the roll 46 for belt 40 and the roll 48 for the belt 42 are drivingly interconnected by a drive chain 52 entrained around corresponding sprockets 54,56. The shaft 58 for the sprocket 56 is in turn driven by a longer downwardly inclined drive chain 60 which receives driving power at its lower end from shaft 62. The shaft 62 in turn is driven by a chain 64 that derives its power from a gear box 66 coupled with a motor 68.

Just upstream from the inserting station 36 is an accelerator 70 which is designed to receive the newspapers 10 from the conveyor 34 and to instantly increase their velocity by several times so that the newspapers are propelled into a bag at the inserting station by the accelerator 70. Generally speaking, the accelerator 70 comprises a pair of high speed, opposed nip rollers 72 and 74 that are alternately separated vertically from one another and dosed down in contact with one another so as to, in effect, open and close the accelerator 70.

As shown for example in FIGS. 1–6, the lower set of nip rolls 74 are mounted on a cross shaft 76 that is immobile except for its high speed rotation. On the other hand, the upper nip rollers 72 are mounted on a cross shaft 78 that is carried at the downstream ends of a pair of vertically swingable levers 84 and 86 on opposite sides of the machine. The two levers 84,86 are mounted for vertical swinging movement about respective transverse pivots 88 and 90. Both of the levers 84,86 extend rearwardly beyond their respective pivots 88,90 and have corresponding pivotal connections 92,94 with relatively short, rearwardly extending legs 96,98. The two legs 96,98 are in turn pivotally joined with the upper ends of long, generally upright motion transmitting links 100 and 102 that are pivotally connected at their lower ends to respective cranks 104 and 106. The cranks 104 and 106 are fixed to opposite ends of a common, transverse drive shaft 108 that causes the cranks 104 and 106 to continuously rotate about the axis of the shaft 108. A pair of guide bars 80 on the shaft 78 extend upstream therefrom and lie loosely on supports 82 to slide back and forth by a small amount as the shaft 78 is swung up and down.

Figure 21:
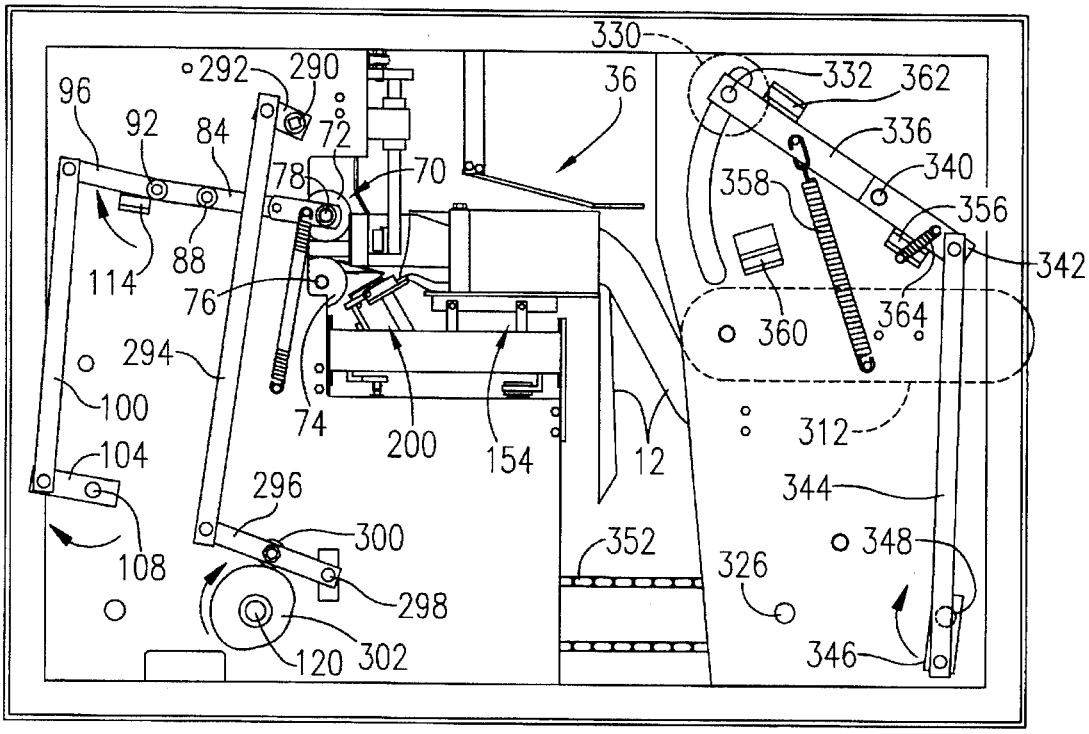
FIG. 21 is a schematic side elevational view of various operating linkage on one side of the machine in the vicinity of the inserting station.
Figure 22:
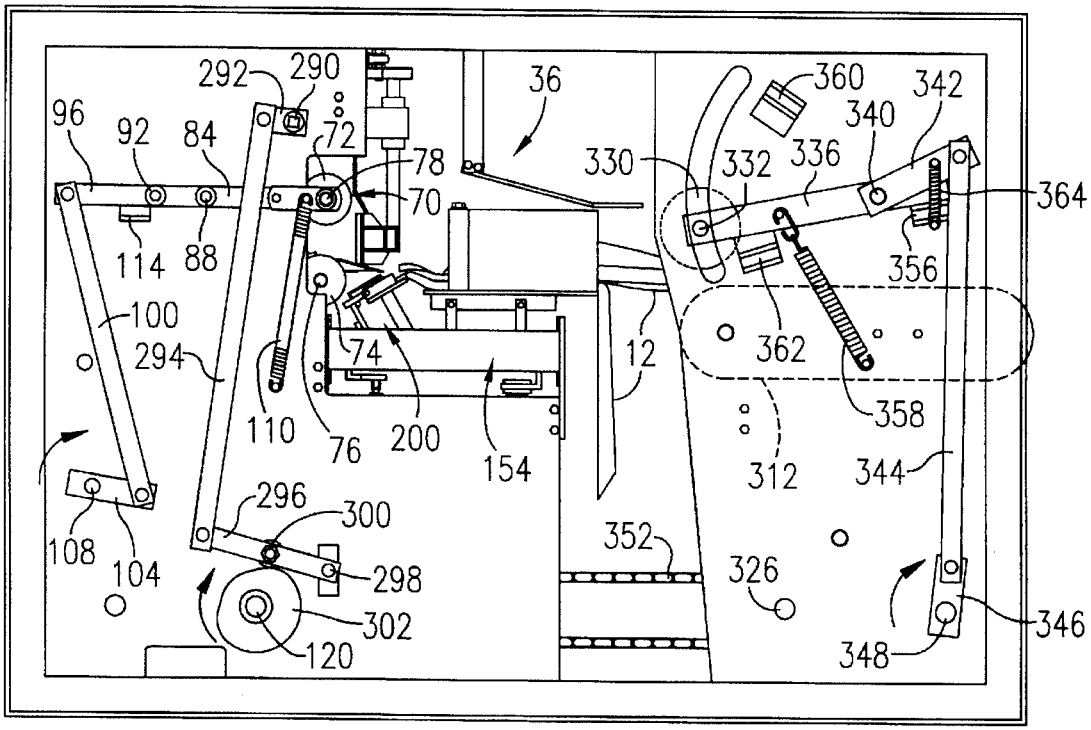
FIG. 22 is a schematic side elevational view similar to FIG. 21 but with the clutch shaft rotated 180 degrees further than in FIG. 21.

A pair of tension springs 110 and 112 on opposite sides of the machine are connected to the respective operating levers 84 and 86 to yieldably bias the same in a downward direction, so that the nip rollers 72,74 are yieldably biased toward a dosed condition. As illustrated in FIGS. 21 and 22 a stop 114 on the rearend of the operating levers 84,86 prevents the legs 96,98 from buckling down past a straight line condition with the corresponding lever 84 or 86 so that, when the links 100,102 pull downwardly on legs 96,98, the legs 96,98 swing downwardly about their respective pivots 92,94 until engaging the stops 114, whereupon further downward motion of the links 100,102 has the effect of raising the nip roller ends of the levers 84,86 about the respective pivots 88,90. This has the effect of separating the nip rollers 72,74 as illustrated in FIG. 22. On the other hand, when the links 100,102 are pushed upwardly by theft cranks 104, 106, the levers 84,86 and their legs 96,98 are allowed to likewise swing upwardly, due in part to the tension in the springs 110, 112. Even after the nip rollers 72,74 are fully down in contact with one another, or have damped against a moving newspaper as will hereinafter be explained, the legs 96 and 98 can continue moving upwardly in a lost motion manner about their pivots 92,94 until the cranks 104,106 go over center and once again begin pulling downwardly on the legs 96,98 through the links 100,102.

With particular reference to FIGS. 4 and 5, it will be seen that the cross shaft 108 carries a sprocket 114 that is entrained by a downwardly and forwardly extending chain 116 which also wraps around a sprocket 118 on a clutched shaft 120. The clutched shaft 120, in turn, receives its driving input from the parallel shaft 62 via a sprocket 122 (FIG. 5), chain 124 and sprocket 126 on shaft 62.

Figures 6, 7:
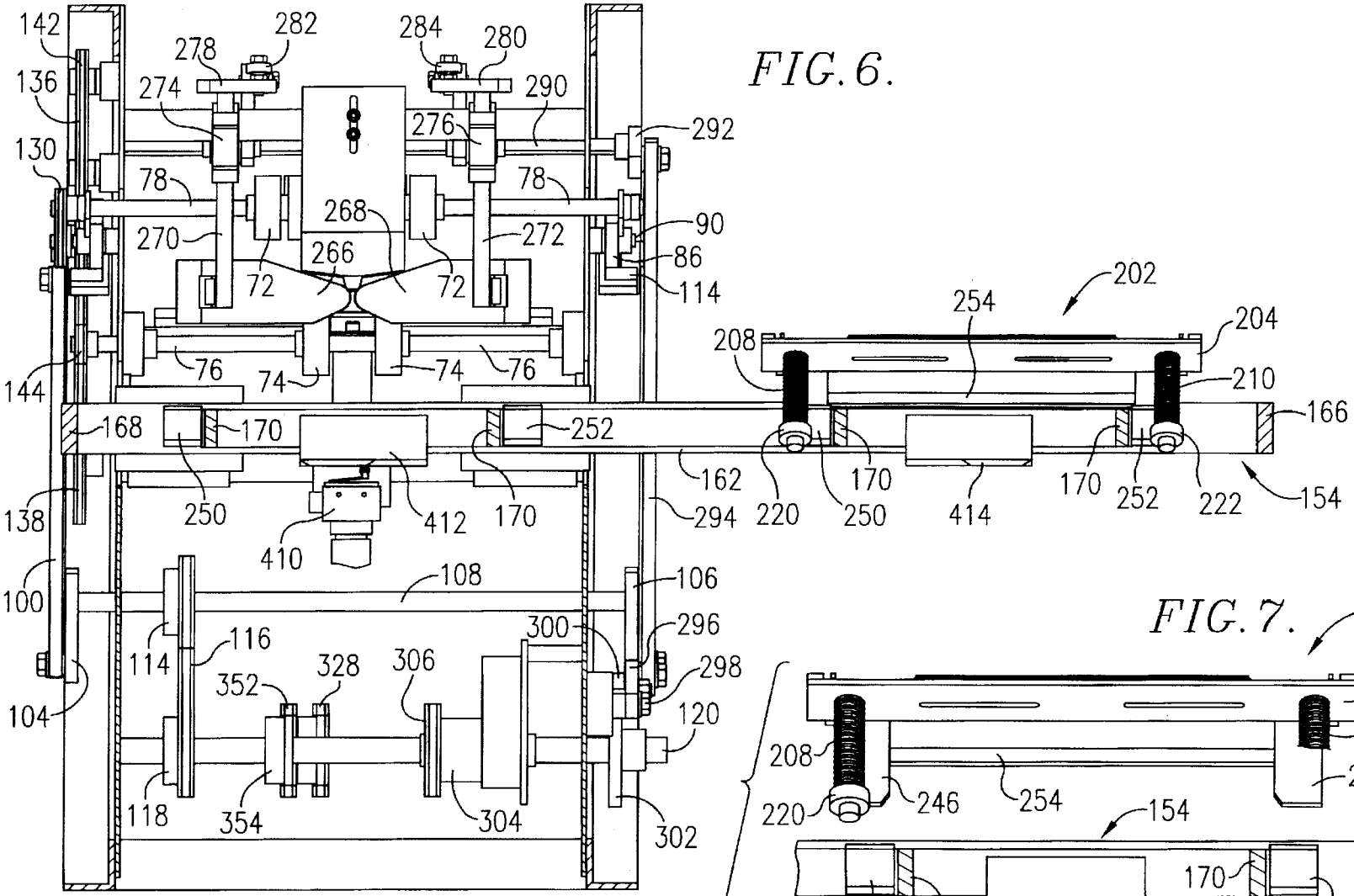
FIG. 6 is a transverse, vertical cross-sectional view through the machine taken at the inserting station and looking back upstream.
FIG. 7 is an enlarged illustration of a bag holding wicket and the manner in which it becomes attached to the shuttle.

The nip rollers 72 and 74 are driven by a chain and sprocket drive mechanism shown best in FIGS. 1, 4, 5 and 6. For the top nip rollers 72, a sprocket 128 on the shaft 78 is entrained by a fore-and-aft extending chain 130, which also wraps around a rear sprocket 132 carried on the pivot 88. Another sprocket 134 (FIG. 5) on the pivot 88 is fixedly connected to the sprocket 32 for transmitting rotary motion thereto, and a chain drive 136 partially wraps around the sprocket 134 to transfer driving power thereto from a large sprocket wheel 138 (FIGS. 1 and 6). The chain drive 136 also is entrained around a small idler sprocket 140 above the sprocket 132 and 134, as well as another uppermost idler 142. Furthermore, the chain drive 136 wraps around the sprocket 144 at the outer end of the shaft 76 of the nip rolls 74 to impart rotary driving power to those rolls. The large sprocket wheel 138 is fixed to a shaft 146 carrying a small sprocket 148 (FIG. 4) that is in turn entrained by a generally upright chain 150 that is wrapped at its lower end around a larger sprocket 152 fixed to the shaft 62. Consequently, driving power to the nip rollers 72 and 74 is supplied to the gear box 66, then to the drive shaft 62, thence to the shaft 146, then to the large sprocket wheel 138, and ultimately to the rolls 72,74 via the drive chain 136.

The inserting station 36 comprises the location in the machine in which the folded newspapers are propelled into the awaiting bags by the accelerator 70. Generally speaking, at station 36, each successive bag is blown open by a strong jet of air, is held in that condition by mechanical fingers and the air, and waits for the oncoming newspaper to complete its entry. The bagged newspaper is then quickly removed from the station 36 and moved downstream to provide space for the next bag and newspaper.

Figure 24:
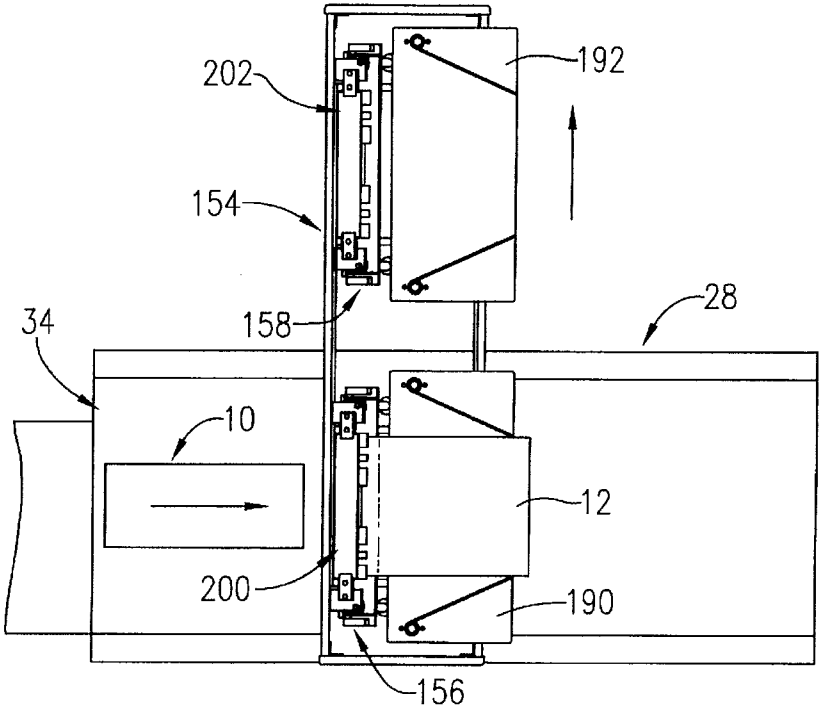
FIGS. 23 and 24 are schematic top plan illustrations of the machine with the bag-supplying shuttle in its two alternative positions.
Figure 23:
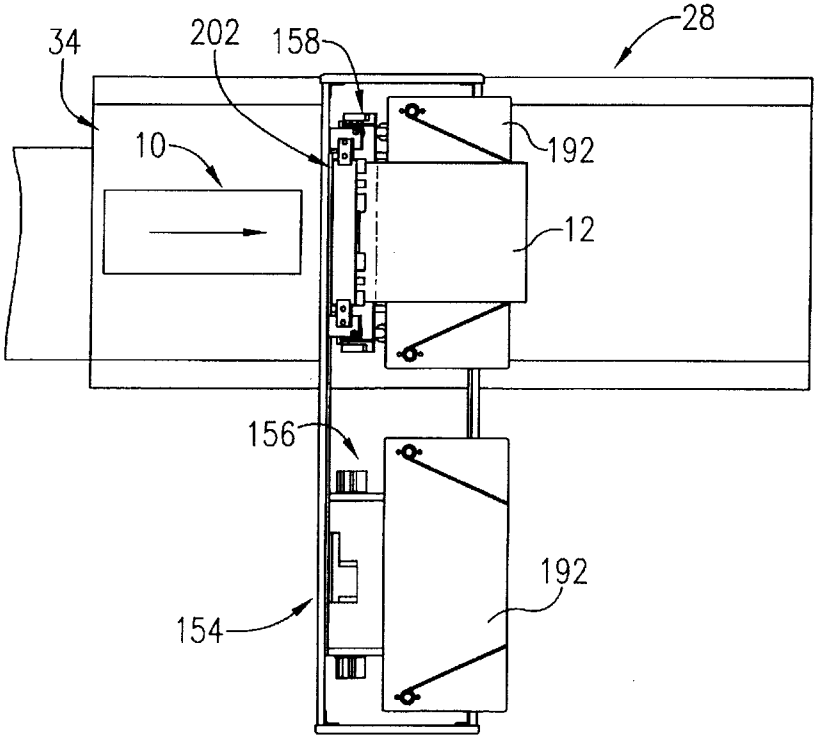

The stacked bags 12 of FIG. 26 are presented to the inserting station 36 on a special elongated, transversely extending shuttle 154 that may be manually shifted back and forth across the path of travel of the newspapers between the two alternative positions illustrated in FIG. 23 and 24. The shuttle 154 has a pair of side-by-side bag-holding zones 156 and 158 located thereon in longitudinally spaced relation to one another for receiving and holding two separate stacks of bags. As illustrated in FIGS. 23 and 24, it is contemplated that only one of the zones 156 or 158 will be in line with the newspaper path of travel at any one time, the other zone being disposed to one side of the inserting station 36 in an access position permitting the operator to replenish the supply of bags at that particular zone.

Figure 8:
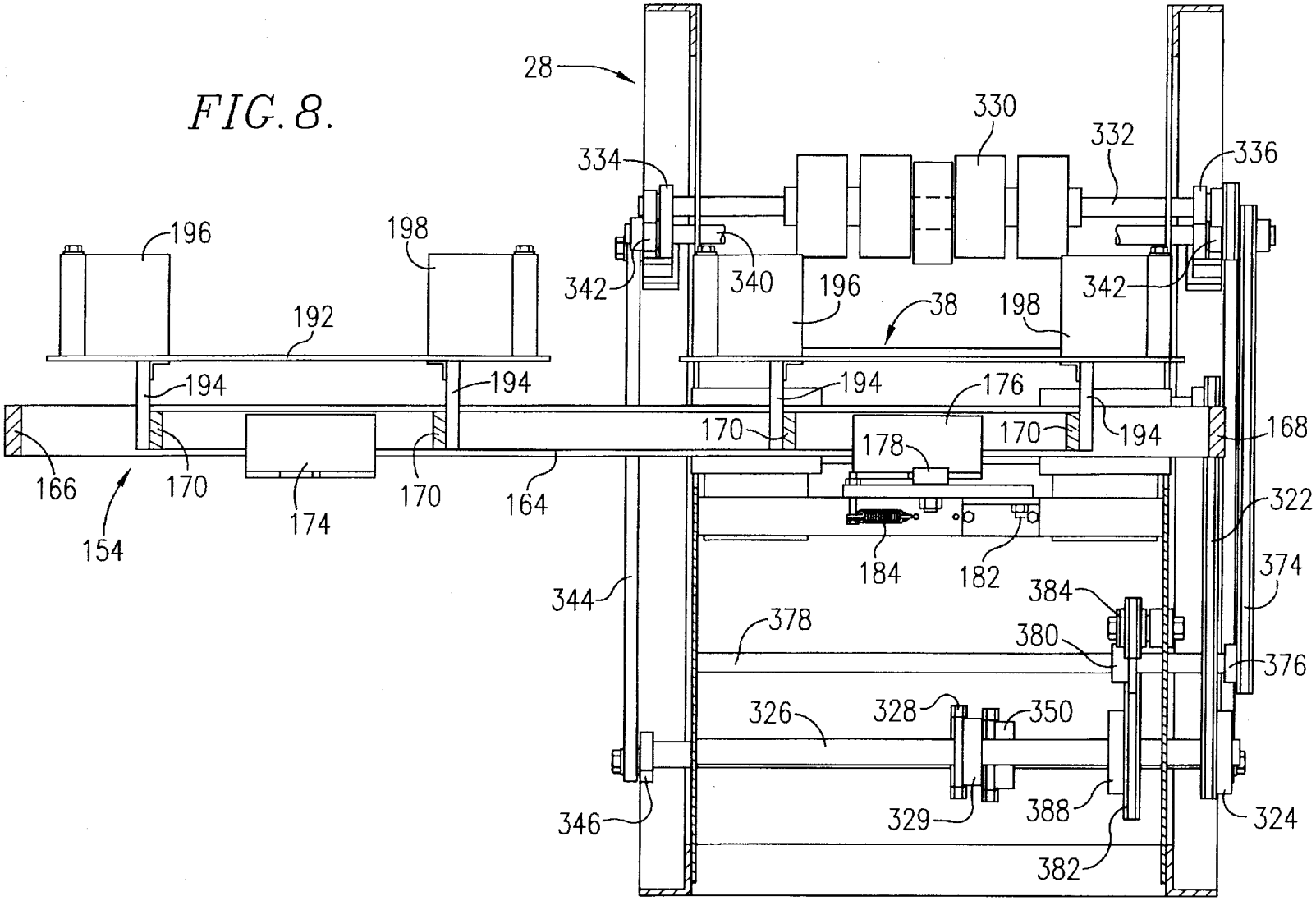
FIG. 8 is a transverse, vertical cross-sectional view through the machine at the inserting station and looking in the downstream direction.
Figure 10:
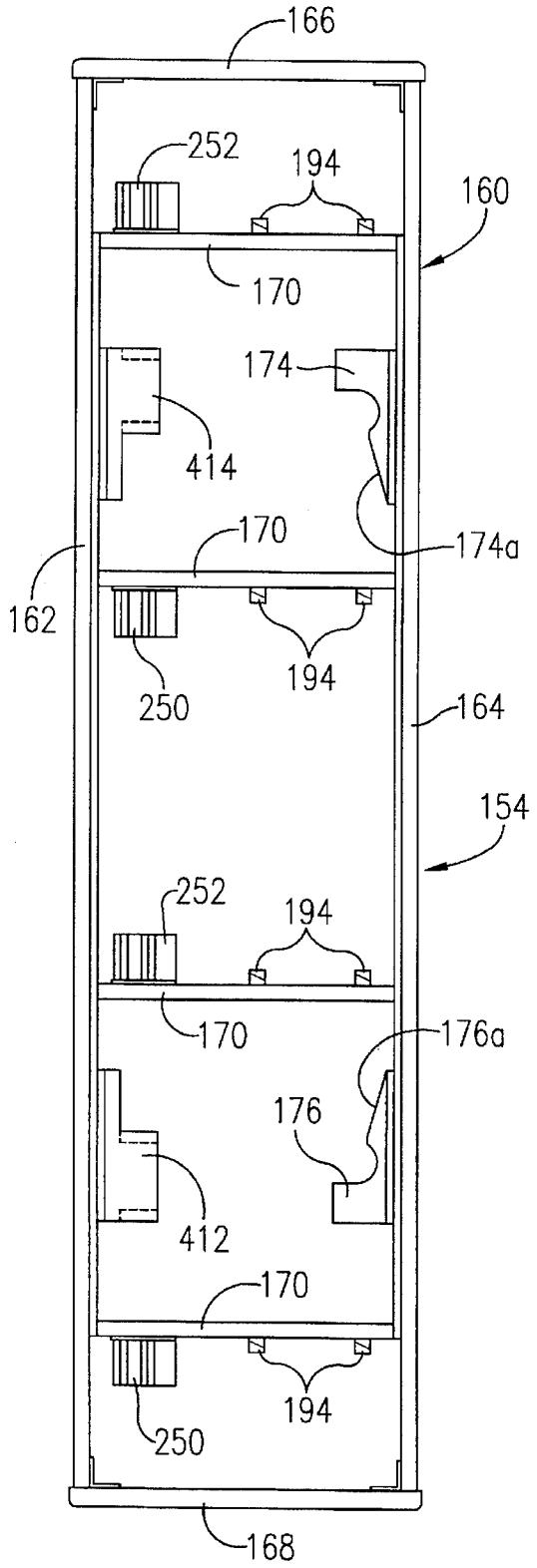
FIG. 10 is a top plan view of the frame of the bag shuttle and various components thereof.
Figure 11:
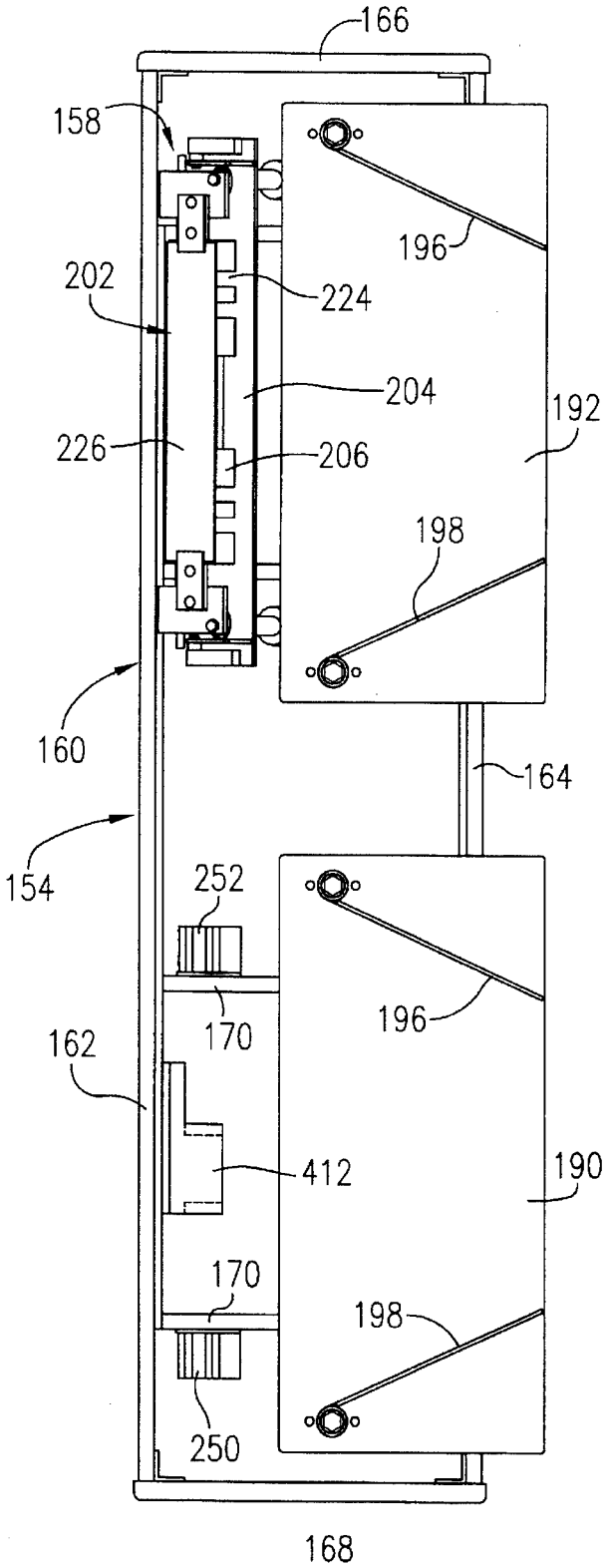
FIG. 11 is another top plan view of the shuttle with a wicket in place at one of the bag holding zones.
Figure 27:
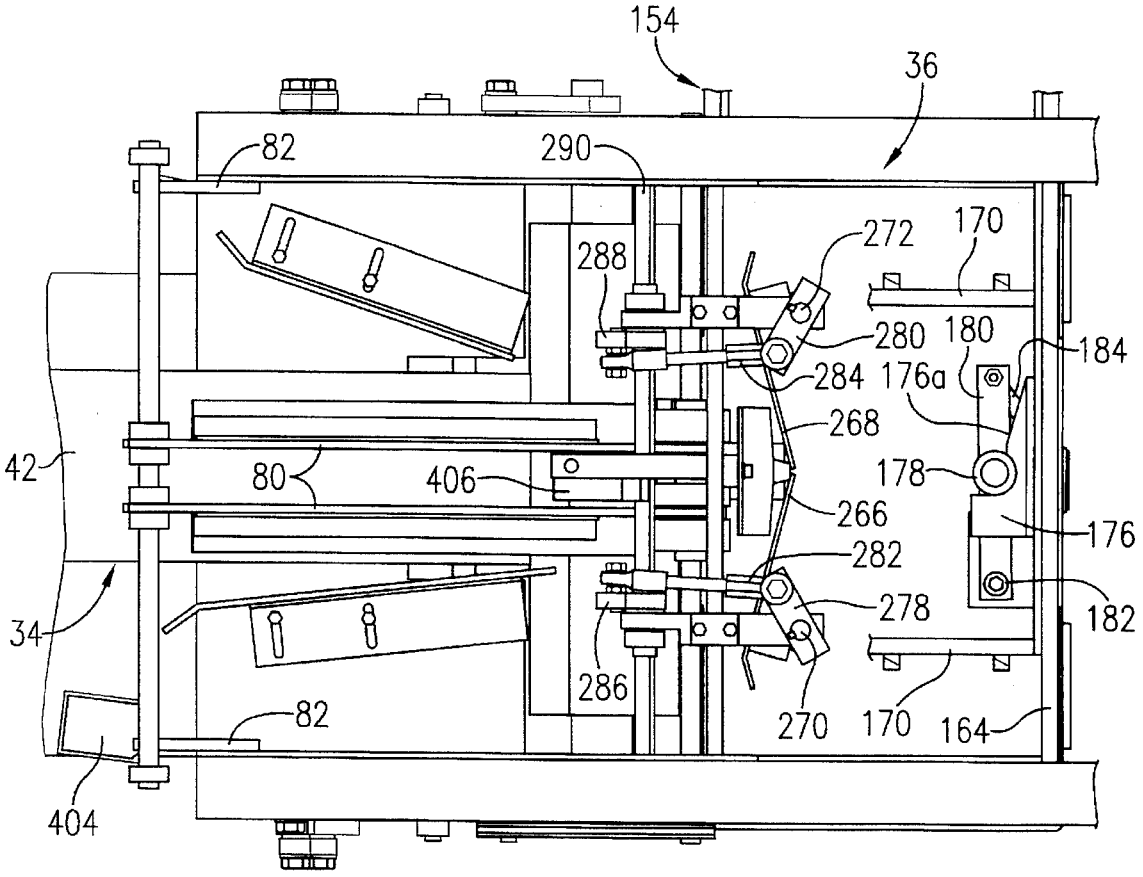
FIG. 27 is a fragmentary top plan view of the bag inserting station and surrounding components with parts being removed to reveal details of construction.

The shuttle 154 is mounted on roller bearings so that it can be easily shifted back and forth between its alternate positions. In this respect, it will be seen from FIG. 10 in particular, and also FIG. 12, that the shuttle 154 has a rectangular, open box frame 160 that includes a pair of channel-shaped side rails 162 and 164 and a pair of opposite end members 166 and 168 that rigidly interconnect the side rails 162,164. There are also four transverse braces 170 interconnecting side rails 162 and 164, in addition to the end members 166,168. The two side rails 162,164 receive and are supported by roller bearings 171 and 172 respectively (FIG. 12) that are stationarily mounted to the frame of the machine. In order to stop the shuttle 154 when it is extended leftwardly out of the machine or rightwardly from the machine as viewed in FIGS. 23 and 24, the shuttle frame 160 is provided with a pair of opposite catches 174 and 176 attached to the inside surface of the rear rail 164. Such two catches 174 and 176 open inwardly toward the center of the machine and face one another at a vertical position matching that of a stop roller 178 (FIGS. 4, 8 and 27) carried on the frame of the machine at the inserting station 36. As shown in FIG. 27, the stop roller 178 is carried by a horizontal arm 180 having a pivotal attachment 182 with the frame of the machine. Thus, in the plan view of FIG. 27, the arm 180 can swing slightly in a clockwise and counterclockwise direction about the pivot 182 and is urged in the clockwise direction by a tension spring 184. Therefore, the stop roller 178 can move up the ramp surfaces 174*a* and 176*a* when the stop 174 or 176 comes into limiting engagement with the roller 178.

The two bag holding zones 156 and 158 on the shuttle 154 are defined in part by a pair of shelves 190 and 192 fixed to the frame 160 by upright struts 194 as shown in FIG. 12, for example. A pair of upright deflector panels 196 and 198 on each shelf 190, 192 converge in a downstream direction so as to confine and guide the stack of bags being held at the holding zone 156 or 158.

The shuttle 154 utilizes a pair of identical bag holders 200 and 202 for holding stacks of bags at the zones 156 and 168 respectively. Using the holder 202 as an example, and referring to FIGS. 6, 7 and 11–15, it will be seen that each holder includes a relatively narrow, flat, base plate 204 which underlies and supports the flap portion 16 of the bags in the stack as illustrated in FIG. 13, for example. The plate 204 is yieldably biased upwardly toward a nylon cover plate 206 for the purpose of clamping the flaps 216 of the bags in between the plates 204 and 206. A pair of coil springs 208 and 210 encircle respective guide posts 212 and 214 to yieldably bias the base plate 204 toward the cover plate 206. The guideposts 2 12 and 214 are fixed to the cover plate 206 and pass through respective clearance openings 216 and 218 in the base plate 204 as illustrated in FIG. 15. Collars 220 and 222 at the lower ends of the guideposts 212 and 214 provide back stops for the compression springs 208 and 210.

The cover plate 206 has four notches 224 (FIG. 11) along its front edge and which are covered at their rear extremities by a somewhat springy retainer plate 226 extending over the full length of the cover plate 206. The front edge of the cover plate 206 is beveled in the nature of an upwardly inclined ramp as shown in FIG. 13, for example, leading to a transverse, full length groove 228 (FIGS. 13 and 15) in the cover plate 206. The four notches 224 in the edge of the cover plate 206 are arranged in spaced pairs to accommodate the depending legs 230 and 232 of a wicket 234 (FIG. 15) used to stake the bags in a stack onto the holder 202. By having two sets of the notches 224, two different size wickets 234 may be used. Each wicket 234 has a bight 236 that rigidly interconnects the legs 230,232 adjacent the upper ends thereof and which is received within the groove 228 when the wicket is in place. As illustrated in FIG. 15, the legs 230,232 of the wicket 234 pass through the mounting holes 22 and 24 of the bags in the stack.

As illustrated in FIGS. 14 and 15, the base plate 204 may be pulled down and separated from the cover plate 206 against the action of the springs 208 and 210 to permit loading of the holder 202 with a stack of the bags. A pair of flip-up braces 238 and 240 may be provided at opposite ends of the base plate 204 when the plates 204,206 are separated whereby to maintain separation during loading of the bags onto the holder 202. With a stack of the bags already staked onto the wicket 234, the lower ends of the wicket legs 230,232 may be inserted into corresponding slits 242 and 244 in the base plate 204. With the bight 236 of the wicket 234 spaced slightly above the top surface of the upper bag, the bight 236 may then be pushed up the front beveled edges of the cover plate 206 and forced beneath the spring retainer plate 226 into the cross groove 228, while the bags enter into the space between the cover plate 206 and the base plate 204. Once the braces 238 and 240 are then released, the base plate 204 springs up against the bag stack and presses it firmly against the bottom of the cover plate 206 as illustrated in FIG. 13. Of course, the bags are carried on the holder 202 with the mouths 18 facing upwardly as illustrated in FIG. 26.

The holders 200 and 202 are each provided with a pair of depending tangs 246 and 248 at opposite ends of the cover plate 206 that fit down into corresponding mounting sockets 250 and 252 (FIGS. 10, 11, 12 and 7) on the shuttle frame 160. Each of the tangs 246 has a shoulder 254 (FIG. 12) that limits the extent of insertion of the tangs 246 into the sockets 250 and 252. As a result of this construction, the holders 200 and 202 may be quickly and easily removed from and re-mounted onto the shuttle 154 to permit replenishing of the bag stack of the empty holder 200 or 202 on a work bench or other suitable fixture, rather than on the shuttle 154 itself.

The top bag in each stack at the inserting station is inflated during the insertion process by a continuous, low pressure stream of air emanating from a nozzle 256 positioned just above the level of the holders 200 and 202 and directed downstream. As illustrated in FIG. 4, the nozzle 256 is located at the upper rear end of an upstanding air pipe 258 that communicates with a blower 260 adjacent the motor 68 via a conduit 262.

Another small, overhead nozzle 264 is supported slightly upstream from the low pressure nozzle 256 and is also aimed at the inserting station 36 for directing a momentary high pressure jet of air at the mouth 18 of each top bag to open the mouth far enough that the low pressure stream from nozzle 256 can enter the bag and fully inflate the same. Thus, it will be seen that the nozzle 264 opens the mouth 18 of each bag while the nozzle 256 then inflates the rest of the bag to provide a wide open receptacle for the oncoming newspaper. The high pressure air for overhead nozzle 264 is supplied by an air compressor (not shown) at the installation site of the machine 28. A suitable electronic control operates the overhead nozzle 264 so that it cuts off just before the newspaper enters the bag and comes on for the next newspaper when the previous, bagged newspaper is partly ejected from the inserting station 36.

To assist the nozzles 256 and 264 in opening the top bag and keeping it open, the machine is provided with a pair of swiveling finger plates 266 and 268 mounted at the lower ends of respective spindles 270 and 272 (FIG. 6). The two spindles 270,272 are situated on opposite sides of the center line of the machine and are journaled for rotary, swiveling movement about respective upright axes by a pair of journals 274 and 276. At their uppermost ends, the spindles 270, 272 are rigidly affixed to respective, horizontal cranks 278 and 280 which are connected at their outer ends to tie rods 282 and 284 extending upstream to a pair of respective upright levers 286 and 288. The levers 286 and 288 are fixed at their lower ends to a rock shaft 290 spanning the machine and projecting outwardly beyond one sidewall thereof. The outwardly projecting end of the rock shaft 290 is fixed to a short crank arm 292 that is pivotally coupled at its free end with the upper end of a long link 294. The link 294 is pivotally connected at its lower end to a follower link 296 having a fixed pivot point 298 which allows the link 296 to swing up and down. A follower roller 300 on the link 296 rides on the outer periphery of a rotary cam 302 fixed to the shaft 120.

The shaft 120 is a clutched shaft and rotates through a single revolution whenever its electric clutch 304 (FIGS. 5 and 6) is actuated. The sprocket 122 on the shaft 120 is constantly rotated through the input power from the drive chain 124 coupled with the sprocket 126 on the constantly rotating drive shaft 62. However, the sprocket 122 is not operable to drive the shaft 120 until the clutch 304 is engaged. When such engagement of clutch 304 occurs, one revolution of the shaft 120 results in flipping the fingers 266,268 from their closed positions of FIG. 6, for example, to opened positions pointing downstream and inserted within the open mouth of the top bag. As the one revolution is completed, the fingers flip back to their closed positions and await the next engagement of the clutch 304. Parenthetically, it is to be noted that in the schematic illustrations of FIGS. 21 and 22, the cam 302 and its associated operating linkage 292–300 for the flipper fingers 266,268 are shown for illustrative purposes on the same side of the machine as the large drive sprocket 138 of FIG. 1. In actual fact, the cam 302 and its operating linkage are on the opposite side of the machine as illustrated in FIGS. 5 and 6 for example.

Such one revolution rotation of the shaft 120 also has the net result of driving the shaft 108 through one complete revolution via the chain 116 and sprockets 114, 118. Thus, the upper nip rollers 72 of the accelerator 70 are clamped down against the lower nip rollers 74 and subsequently opened back up as the revolution is completed. Like the flipper fingers 266,268, the upper nip rollers 72 await the next engagement of the clutch 304 before they are once again clamped down against the lower nip rollers. The discharge conveyor 38 located slightly downstream from the inserting station 36 includes a wide flat belt 3 12 entrained around a pair of cylinders 314 and 316. The cylinder 314 is driven by a transverse shaft 318 (FIGS. 1 and 4) having a sprocket 320 fixed to one outer end. The sprocket 320 is, in turn, entrained by an upright drive chain 322 that is also entrained around a larger sprocket 324 at the lower end of the chain 322. The sprocket 324 is fixed to a transverse shaft 326 that is constantly driven by a long, fore-and-aft extending drive chain 328 (FIGS. 4, 5 and 1) entrained around a sprocket 329 on the shaft 326 and a sprocket 331 on the constantly rotating shaft 62. Therefore, the belt 312 is likewise constantly driven during operation of the machine.

The conveyor 38 also includes a set of upper nip rollers 330 that function much like the nip rollers 72 of the accelerator 70. Thus, the nip rollers 330 open and dose against the lower cylinder 3 14. To carry out the opening and closing action, the nip rollers 330 are carried on a shaft 332 that is supported at its opposite ends by a pair off-ore-and-aft arms 334 and 336 on opposite sides of the machine. The arms 334 and 336 are mounted for vertical swinging movement about a transverse shaft 340 and have portions that extend rearwardly beyond the shaft 340. A lost motion bar 342 on each end of the shaft 340 is pivotally connected at its rearmost end with an upright link 344 which in turn is pivotally connected at its lower end to a crank 346. The cranks 346 on opposite sides of the machine are fixed to opposite ends of a shaft 348 having a sprocket 350 fixed thereto near its center. The sprocket 350 is entrained by a long, fore-and-aft extending chain 352 that, at its forward end, is entrained around a sprocket 354 on the clutched shaft 120. Thus, each time the shaft 120 is driven through one revolution, such motion is correspondingly transmitted to the shaft 348 to cause the cranks 346 to rotate through one full revolution. As the links 344 are pulled downwardly by the cranks 346, the swing arms 334 and 336 of the upper nip rollers 330 are swung upwardly to separate the nip rollers 330 and 3 14. In this respect even though the lost motion bars 342 receive the pull down force from the links 344 and lost motion bars 342 are pivoted to the arms 336, arms 336 and bars 342 effectively move as a single long lever at this time because of a stop 356 on the lower rear edge of the arm 336 that prevents each bar 342 from swinging down past a straight-line condition with the arm 336.

As the cranks 346 then rotate over center and push upwardly on the links 344, the front ends of the arms 336 are forced downwardly, aided by tension springs 358. The arms 336 are provided at their upper and lower limits of travel with bounce dampener blocks 360 and 362 respectively that are located within the path of travel of each arm 336. A small tension spring 364 connected between each stop 356 and the corresponding rear lost motion bar 342 yieldably biases the bar 342 toward a straight line condition with the arm 336 yet allows the bar 342 to be raised relative to the arm 336 as shown in FIG. 22. This provides spring relief for over travel of the link 344 when the upper nip rolls 330 clamp down against a bagged newspaper and are thus prevented from coming into complete contact with the lower nip roll 314.

The upper nip rolls 330 are driven through a chain and sprocket drive line that is ultimately connected to the main drive shaft 62. In this respect, the shaft 332 of the upper nip rolls 330 has a sprocket 366 (FIG. 1) at one outer end that is entrained by a drive chain 368 which also entrains a sprocket 370 (FIG. 9) on the shaft 340. The shaft 340 has another sprocket 372 fixed thereto at its outer end which is entrained by an upright drive chain 374 looped around a sprocket 376 at its lower end. The sprocket 376, in turn, is fixed to the outer end of a shaft 378 (see also FIG. 5) carrying a sprocket 380 at its inner end.

The sprocket 380 is back wrapped by a drive chain 382 (see also FIG. 4) which entrains a pair of idler sprockets 384 and 386, as well as a larger sprocket 388 on the shaft 326. Since the shaft 326 is continuously driven by the chain 328 and shaft 362, the upper nip rollers 330 are also continuously driven.

It is to be noted that the various chain and sprocket drives associated with the infeed conveyor 34, the accelerator 70, and the discharge conveyor 38 are such that those three assemblies are not driven at the same speed. The infeed conveyor 34 is driven at a first velocity, while the accelerator rolls 74 and 72 have a peripheral speed that is several times greater than the linear speed of the infeed conveyor 34. The discharge conveyor 38 is faster than the infeed conveyor 34, but somewhat slower than the accelerator 70.

FIG. 16 illustrates the diverter mechanism 390 that is utilized to diver incoming newspapers off the conveyor 34 during the time that the shuttle 154 is being shifted for placing a new stack of bags at the inserting station 36. In relevant part, such divergent mechanism 390 includes a deflector arm 392 mounted on an upright pivot 394 beside the infeed conveyor 34. The deflector arm 392 is disposed to swing horizontally about the pivot 394 between a position parallel with the path of newspaper travel along one side of the conveyor 34 and a position oblique to such path of travel extending diagonally across the conveyor 34 as shown in FIG. 16. In such diverting position, the oncoming newspapers are prevented from reaching the inserting station 36 and are instead caused to fall off the far side of the machine. In order to swing the deflector arm 392 between its alternative positions, a double-acting air cylinder 396 (FIG. 16) actuates a crank arm 398 which is rigidly fixed to the inner end of the deflector 392. The air cylinder 396 is operated by a control system described below.

Many of the controls for regulating the ongoing operation of various parts of the machine include photoelectric sensors of the type which transmit a beam of light to a reflector which returns the beam to a receiver part of the transmitter unless the beam is broken by the presence of some obstruction. For example, as illustrated in FIG. 16, the optical sensor 400 is positioned slightly above the path of travel of folded newspapers on the conveyor 34 to indicate that properly folded and tied newspapers are traveling along the line. If a mistie has occurred upstream from the conveyor 34, then the newspaper will be open and present a higher profile than would otherwise be the case. Consequently, the mistied newspaper breaks the light beam associated with the sensor 400, triggering the air cylinder 346 and causing the deflector 392 to divert the mistled paper off the line. As long as no mistled papers are presented, the deflector 392 will remain in its standby position and the newspapers continue to move in their regular order down the line.

The next sensor 402 (FIG. 16) determines whether a newspaper is at the diverter when it is time to return the diverter to its standby position. A third sensor 404 at the mid-point of conveyor belt 42 determines whether a newspaper is too far down the line to be successfully diverted when the bag supply sensor 408 detects an empty condition.

Another sensor 406 (FIG. 4 and 17–20) just upstream from the inserting station 36 checks to see of a newspaper is approaching or at the inserting station 36. Sensor 406 is connected with the electric clutch 304 to engage and disengage the clutch depending upon what condition is detected by sensor 406.

Additionally, a sensor 408 (FIGS. 16–17) situated just below the discharge conveyor 38 adjacent the inserting station 36 checks to determine if the supply of bags at the inserting station is empty. Such sensor 408 is connected with the diverter 390 to operate the air cylinder 396 of the deflector arm 392 when bags are gone.

Another type of sensor consists of a limit switch 4 10 (FIG. 6) at the inserting station 36 just below the shuttle 154. A pair of downwardly projecting switch actuators 412 and 414 are spaced apart along the shuttle frame 160 (see also FIG. 10) to engage and operate the switch 410 when the shuttle 154 is properly located with either of the bag holding zones 156 and 158 in alignment with the accelerator 70. Unless the switch 410 is depressed by one or the other of the actuators 412 and 414, the diverter 390 will remain actuated to prevent newspapers from reaching the inserting station 36.

OPERATION

The operation of the machine should be apparent from the detailed description set forth above. Accordingly, only a brief discussion of the use and operation of the machine would appear to be necessary.

FIG. 25 illustrates a typical folded and tied newspaper presented to the bagging machine from the discharge outlet 26 of the folder/tier as earlier explained. Generally speaking, the stream of newspapers 10 enters the machine at its left end viewing FIG. 1, is conveyed in a rightward direction until reaching the inserting station 36, is propelled into an open bag at the station 36 and is then propelled away from the station 36 in a rightward direction as a bagged newspaper. The final bagged product appears as exemplified by the bagged newspaper 14 in FIG. 26.

FIG. 3 shows the bag holding shuttle 154 in a rightwardly shifted position as viewed from the discharge end 32 of the machine looking back upstream. This corresponds to the condition of things illustrated in FIG. 24 in which the left bag holding zone 156 and bag holder 200 are at the inserting station 36 in alignment with the path of newspaper travel. FIG. 24 shows the holder 200 filled with a stack of bags 12 while the holder 202 is empty. The stack of bags is gripped by the holder 202 at the flap 16 so that the mouth 18 of the bags faces upwardly and upstream, while the main body of the bag rests upon the shelf 190 and drapes over the downstream edge thereof as illustrated in FIG. 16.

As illustrated in FIG. 24, each newspaper 10 is conveyed by the conveyor 34 in a rightward direction toward the stack of bags 12. Just before the newspaper reaches the accelerator 70, the nip rollers 72,74 are in a separated condition as illustrated in FIG. 17. The leading edge of the newspaper breaks the light beam from sensor 406 to trigger a new accelerating, inserting and ejecting cycle for the newspaper, which is initiated by engagement of the electric dutch 304. Such engagement of the clutch 304 causes the clutch shaft 120 to rotate through one complete revolution, during which time the next bag will be opened, the newspaper will be fired into the bag, and the bagged newspaper will be ejected from the inserting station.

As illustrated in FIG. 17, by the beginning of each clutch cycle, the high pressure air nozzle 264 has already been on for a short instant during departure of the previous bagged newspaper from the inserting station. The high pressure air causes the mouth 18 of the next bag to partially open. The gate-like fingers 266,268 are "closed" at this time, as they extend across the path of travel of the newspapers.

Then, as illustrated in FIG. 18, by the time the clutched shaft 120 has completed of its revolution, the high pressure air nozzle 264 has shut off and the continuous, low pressure air nozzle 256 has inflated the bag to "pop" it up above the ejector conveyor 38 into direct horizontal alignment with the oncoming newspaper. Activation and deactivation of the high pressure nozzle 264 is controlled by a roller microswitch (not shown) on the shaft 348 which controls opening and closing of the rear nip rollers 330, 314.

Additionally, by the FIG. 18 position of the newspaper, the fingers 266,268 have flipped to parallel positions and are projecting into the bag to hold the mouth wide open. The newspaper has moved into position between the nip rollers 72,74, with the leading edge of the newspaper just upstream of the mouth of the bag. Furthermore, the upper nip rollers 72 have closed down against the newspaper so that the newspaper suddenly comes under the control of the nip rollers 72 and 74. Because the nip rollers 72, 74 are rotating at a high rate of speed compared to the conveyor belt 34, the nip rollers suddenly accelerate the newspaper and "fire" it rightwardly toward the open bag.

As illustrated in FIG. 19, by the time the clutched shaft 120 has completed ½ of its revolution, the newspaper is in the process of being propelled into the bag by the accelerating nip rollers 72,74, and the ejector nip rollers 330 and 314 are beginning to close upon the leading end of the bag.

Figure 20:
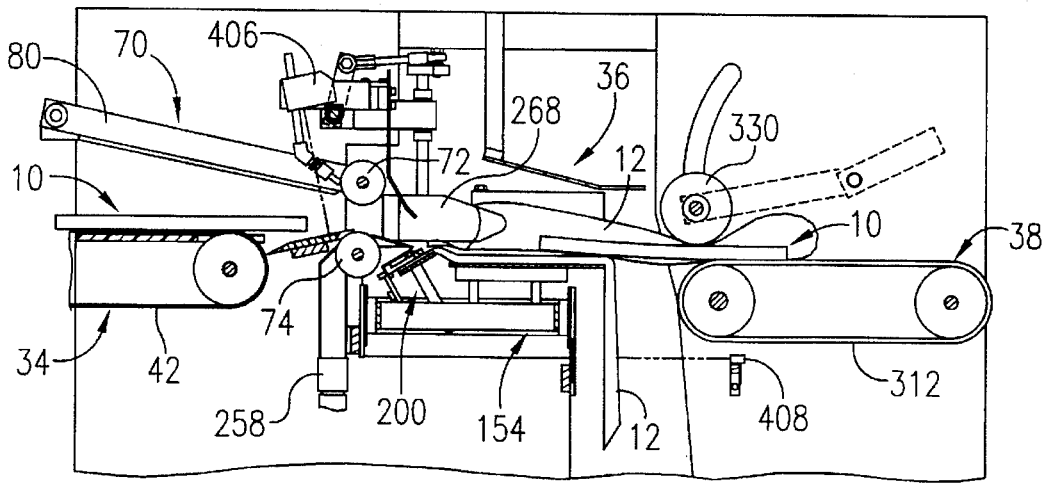
FIG. 20 schematically shows the newspaper fully inserted into the bag, the ejector rollers clamped about the bagged newspaper, and the bagged paper torn from the stack of bags as it is impelled away from the inserting station.

As illustrated in FIG. 20, by the time the clutched shaft 120 has completed ¾ of its revolution, the newspaper has become fully inserted into the bag and the ejector nip rollers 330,314 have clamped down on the bagged newspaper. Also by this time, the ejector nip rollers 330 and 314 will have taken control of the bagged newspaper and will have pulled it off the wicket 234 of the holder 200. Thus, the bagged newspaper is free to be pulled completely out of the inserting station 36 and moved on down the line to the right. The accelerating nip rollers 72, 74 start to reopen.

By the time a full revolution of the clutched shaft 120 is completed, the ejecting nip rollers 330,314 have opened back up and the bagged newspaper has been moved further downstream by the discharge conveyor 38. The fingers 266,268 have reclosed and the next newspaper is approaching the inserting station 36 as illustrated in FIG. 17.

This sequence of events continues until such time as the sensor 408 detects the fact that there are no more bags on the shelf 190 at the inserting station 36. An appropriate control signal causes the air cylinder 396 of the diverter 390 to be activated, instantly swinging the deflector arm 392 into its oblique position of FIG. 16. Therefore, instead of reaching the inserting station 36, the stream of newspapers is diverted to one side as illustrated in FIG. 16. There is no stopping or slowing down of the supply of newspapers from the folder/tier.

In order to restart the flow of newspapers to the inserting station, the operator need only shift the shuttle 154 from its FIG. 24 position to its FIG. 23 position, which brings a fresh supply of bags to the inserting station. These are the bags held by the holder 202 in FIG. 23 and draped onto the shelf 192. Once the new supply of bags is present at the inserting station 36, such presence is detected by the sensor 408, which again generates a signal that causes the diverter 390 to return to its standby position along side the conveyor 34.

It should be noted that unless the shuttle 154 has been shifted to its full operating position of FIG. 23, the mere presence of bags at the inserting station 36 as detected by the sensor 408 will not cause the diverter 390 to return to its standby position. This is due to the presence of the limit switch 410 (FIG. 6) which must be depressed by an appropriate one of the actuators 412 or 414 in order to allow the newspapers to come down the line to the inserting station 36. The actuators 412 and 414 are so located as to depress the limit switch 410 only when the shuttle 154 is positioned with one or the other of its bag holding zones 156 and 158 fully aligned with the deed conveyor 34.

It will also be understood that during the time one of the holding zones 156,158 is at the inserting station 36, the other holding zone may be replenished with a fresh supply of bags. The holders 200 and 202 are readily removed from the shuttle 154 by simply pulling upwardly on the holder to slip the tangs 246,248 out of the sockets 250, whereupon a new, fully loaded holder may be installed. The removed holder may be taken to a work bench or loading fixture and provided with a new stack of bags in the manner described in the earlier portion of this description.

As earlier explained, the sensor 400 (FIG. 16) is used to detect whether a mistie has occurred upstream from the infeed conveyor 34, in which event it is desirable to divert the untied newspaper out of the stream of papers being fed to the inserting station 36. The sensor 400 detects a mistie condition by having its light beam broken by upwardly projecting, portions of the loose newspaper.

The second sensor 402 in FIG. 16 comes into play during the diverting action which occurs when the shuttle 154 is shifted to place a new stack of bags at the inserting station 36. In this respect, even ff the sensor 408 at the inserting station 36 detects the fact that a new supply of bags is in position, the sensor 402 at the infeed conveyor 34 will not allow the diverting arm 392 to be returned to its standby position of there is a newspaper currently being diverted by the arm 392. This is to avoid accidental jams from partially diverted newspapers attempting to return to the normal path of travel.

The sensor 404 also comes into play when the current bag supply at the inserting station 36 is depleted. In this respect, if the sensor 404 detects the presence of a newspaper on the conveyor 34 at the light beam emitted by sensor 404, the diverter 390 will be prevented from being actuated to its diverting position even though the sensor 408 at inserting station 36 has detected the absence of bags. This prevents the diverter arm 392 from attempting to deflect a newspaper that is too far along the conveyor 34 to be successfully diverted and to prevent the possibility of that particular newspaper from jamming up in the machine. The undiverted, extra newspaper simply passes harmlessly on downstream to the inserting station 36 and out the machine without being bagged.

Although only a single electric dutch 304 has been illustrated in the drawings and described above, it has been found that the timing between the accelerating nip rollers 72,74 and the ejector nip rollers 330,314 can be improved through the use of a second electric clutch. Such second clutch has been incorporated into the shaft 348 so as to drive the linkage 342–346 only during the time that the second clutch is engaged. A suitable limit switch (not shown) adjacent the clutched shaft 120 is mechanically actuated when the clutched shaft 120 begins its revolution, to in turn engage the electric clutch associated with the rear shaft 348.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. In a machine for inserting a supply of articles one-at-a-time into a quantity of flimsy bags, the improvement comprising:

an inserting station;

a conveyor for feeding said articles in succession toward said inserting station;

mechanism for successively presenting said bags to the inserting station in an open condition for receiving a corresponding article from the conveyor;

an accelerator between the inserting station and the conveyor for receiving articles in succession from the conveyor and propelling each successive article at an increased velocity into its open bag;

an ejector at the inserting station for receiving each bagged article as it is completed at the inserting station and sending it downstream in a delivery condition, said mechanism including structure for holding bags in a stack at the inserting station and an air nozzle disposed to inflate the top bag of the stack just prior to arrival of the next article from the accelerator, said structure including a shuttle having at least a pair of stack holding zones thereon.

said shuttle being shiftable relative to said inserting station to place a selected one of said holding zones at the station and to place a second holding zone in a location which permits access to the second holding zone for replenishing the stack of bags at the second holding zone while the supply of bags at said one holding zone is being depleted;

a low supply detector at said inserting station for determining when the number of bags in the stack at the inserting station diminishes to a predetermined level; and a diverter upstream from said accelerator for temporarily diverting articles from their normal path of travel to the inserting station and causing them to bypass the inserting station until an adequate supply of bags has been placed at the inserting station.

2. In a machine for inserting articles as claimed in claim 1, said shuttle having a bag stack holder removably carried thereby at each of said holding zones, each of said holders having components for attaching a stack of bags in place on the holder so that when the holder is removed from the shuttle a new supply of bags may be attached to the holder.

3. In a machine for inserting articles as claimed in claim 1, said low supply detector including optical mechanism.

4. In a machine for inserting a supply of articles one-at-a-time into a quantity of flimsy bags, the improvement comprising:

an inserting station;

a conveyor for feeding said articles in succession toward said inserting station;

mechanism for successively presenting said bags to the inserting station in an open condition for receiving a corresponding article from the conveyor;

an accelerator between the inserting station and the conveyor for receiving articles in succession from the conveyor and propelling each successive article at an increased velocity into its open bag; and an ejector at the inserting station for receiving each bagged article as it is completed at the inserting station and sending it downstream in a delivery condition, said accelerator including a pair of opposed, high speed nip rollers and means for relatively shifting said rollers toward and away from one another, said shifting means being operable to alternately separate said rollers for receiving an article therebetween from the conveyor and to clamp the rollers against the received article for propelling it into the open bag.

5. In a machine for inserting articles as claimed in claim 4, said ejector including a second pair of opposed nip rollers and means for relatively shifting said second pair of rollers toward and away from one another, said shifting means for the second pair of rollers being operable to alternately separate said second pair of rollers for receiving a bagged article therebetween and to clamp the rollers against the bagged article for propelling it in the delivery direction.

6. In a machine for inserting articles as claimed in claim 5, said mechanism including a shuttle between said accelerator rollers and said ejector rollers and having at least a pair of stack holding zones thereon, said shuttle being shiftable relative to said inserting station to place a selected one of said holding zones at the station and to place a second holding zone in a location which permits access to the second holding zone for replenishing the stack of bags at the second holding zone while the supply of bags at said one holding zone is being depleted.

7. In a machine for inserting articles as claimed in claim 6, said shuttle having a bag stack holder removably carried thereby at each of said holding zones, each of said holders having components for attaching a stack of bags in place on the holder so that when the holder is removed from the shuttle a new supply of bags may be attached to the holder.

8. In a machine for inserting articles as claimed in claim 7;

a low supply detector at said inserting station for determining when the number of bags in the stack at the inserting station diminishes to a predetermined level; and a diverter upstream from said accelerator for temporarily diverting articles from their normal path of travel to the inserting station and causing them to bypass the inserting station until an adequate supply of bags has been placed at the inserting station.

9. In a machine for inserting articles as claimed in claim 8, said low supply detector including optical mechanism.

10. In a machine for inserting articles as claimed in claim 4, said articles comprising newspapers; and apparatus for delivering said newspapers to the conveyor one-at-a-time in a folded condition.

11. In a method of inserting a supply of articles into a quantity of flimsy bags, the improvement comprising:

conveying the articles in succession along a path of travel toward a stationary stack of the bags;

opening the top bag in the stack for each successive article arriving at the stack;

accelerating each article as it approaches the open bag so that the article is propelled into the bag at an increased velocity;

simultaneously gripping each article as it is accelerated; and ejecting each bagged article from the stack as it is completed.

12. In a method of inserting a supply of articles as claimed in claim 11, said opening step being carried out using an air stream.

13. In a method of inserting a supply of articles as claimed in claim 11;

placing a new stack of bags in the path of travel of the articles when the existing stack diminishes to a certain level; and temporarily diverting the articles from their normal path of travel while the new stack is being placed in position.

14. In a method of inserting a supply of articles as claimed in claim 13;

before placing a new stack of bags in the path of travel of the articles, detecting when the existing stack reaches said certain level; and commencing said diverting step in response to said detecting step.

15. In a method of inserting a supply of articles as claimed in claim 11, said articles comprising newspapers; and before said conveying step, folding each newspaper into a compact condition.

16. In a method of inserting a supply of articles as claimed in claim 15; and binding each folded newspaper in its compact condition after folding and before carrying out said conveying step on the newspaper.

* * * * *